US012612910B2

(12) United States Patent
Avey et al.

(10) Patent No.: US 12,612,910 B2
(45) Date of Patent: Apr. 28, 2026

(54) FLUID END WITH COUNTERFLOW PASSAGES

(71) Applicant: GD Energy Products, LLC, Tulsa, OK (US)

(72) Inventors: Adam Bradley Avey, Chicago, IL (US); Konner Casey Kay, Broken Arrow, OK (US); Laramie Rose Smith, Owasso, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/922,476

(22) Filed: Oct. 22, 2024

(65) Prior Publication Data

US 2025/0137454 A1 May 1, 2025

Related U.S. Application Data

(60) Provisional application No. 63/593,269, filed on Oct. 26, 2023.

(51) Int. Cl.
*F04B 53/16* (2006.01)
*F04B 53/00* (2006.01)

(52) U.S. Cl.
CPC ..... *F04B 53/16* (2013.01); *F04B 53/007* (2013.01)

(58) Field of Classification Search
CPC ..... F04B 53/16; F04B 53/007; F04B 1/053; F04B 53/006
See application file for complete search history.

(56) References Cited

U.S. PATENT DOCUMENTS

| | | | | |
|---|---|---|---|---|
| 4,430,048 | A * | 2/1984 | Fritsch | F04B 43/0054 417/389 |
| 5,073,096 | A * | 12/1991 | King | F04B 53/1022 417/570 |
| 9,976,544 | B2 * | 5/2018 | Morreale | F04B 53/22 |
| 10,883,865 | B2 | 1/2021 | Bestic et al. | |
| 11,162,479 | B2 * | 11/2021 | Thomas | F04B 53/1022 |
| 11,300,111 | B2 | 4/2022 | Thomas et al. | |
| 11,578,711 | B2 * | 2/2023 | Thomas | F04B 7/0003 |
| 11,644,018 | B2 * | 5/2023 | Thomas | F04B 53/007 417/567 |
| 11,808,254 | B2 * | 11/2023 | Thomas | F16K 15/063 |
| 11,965,504 | B2 * | 4/2024 | Foster | F04B 53/22 |
| 12,018,662 | B2 * | 6/2024 | Keith | F16K 1/42 |
| 12,152,684 | B2 * | 11/2024 | Pendleton | F16K 27/003 |

(Continued)

*Primary Examiner* — Jesse S Bogue
(74) *Attorney, Agent, or Firm* — Edell, Shapiro & Finnan, LLC

(57) ABSTRACT

A fluid end includes a fluid end body and a plurality of passages formed in the fluid end body. The fluid end body includes a suction chamber and a plurality of bore segments that extends through the fluid end body. A bore segment of the plurality of bore segments interfaces with a reciprocating element that creates suction and discharge pressures in the suction chamber, and at least two bore segments of the plurality of bore segments support respective valves configured to control ingress and egress of fluid with respect to the suction chamber. The plurality of passages interconnects a pair of the plurality of bore segments so that fluid can flow from one of the respective valves to another of the respective valves in response to reciprocation of the reciprocating element.

20 Claims, 6 Drawing Sheets

(56) References Cited

U.S. PATENT DOCUMENTS

| | | | | |
|---|---|---|---|---|
| 12,359,517 | B2 * | 7/2025 | Belshan | E21B 43/2607 |
| 2004/0234404 | A1 * | 11/2004 | Vicars | F04B 53/16<br>417/571 |
| 2008/0080994 | A1 * | 4/2008 | Gambier | F04B 17/05<br>92/169.2 |
| 2010/0158727 | A1 * | 6/2010 | Hawes | F04B 39/121<br>417/521 |
| 2011/0155254 | A1 | 6/2011 | Swindells | |
| 2023/0022890 | A1 | 1/2023 | Thomas et al. | |
| 2023/0340948 | A1 * | 10/2023 | Foster | F16H 57/0421 |

* cited by examiner

FLUID END WITH COUNTERFLOW PASSAGES

CROSS-REFERENCE

The present application claims priority to and the benefit of U.S. Provisional Patent Application No. 63/593,269, entitled "FLUID END WITH COUNTERFLOW PASSAGES," filed Oct. 26, 2023, and hereby incorporated by reference in its entirety for all purposes.

TECHNICAL FIELD

The present disclosure relates to the field of high pressure reciprocating pumps and, in particular, to a fluid end of a high pressure reciprocating pump, the fluid end having counterflow passages.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end may include a crankshaft that drives a plurality of reciprocating plungers or pistons near or within the fluid end to pump fluid at high pressure. The fluid end includes a chamber in which fluid is received and pressurized via the reciprocating plungers of the power end. Thus, there is a need to enable fluid flow into the fluid end to the chamber and from the chamber out of the fluid end.

SUMMARY

The present application relates to a fluid end of a high pressure reciprocating pump. The techniques may be embodied as a fluid end. As is detailed below, the fluid end of the present application might include a fluid end body with passages formed in the fluid end body to provide counterflow features within the fluid end body. Thus, the counterflow passages are integral to the fluid end. The counterflow passages collectively form a fluid routing plug configured to direct fluid into and out of a pumping chamber of the fluid end body.

In accordance with at least one embodiment, the present application is directed to a fluid end having a monolithic fluid end body and a plurality of passages formed in the monolithic fluid end body. The monolithic fluid end body includes a suction chamber and a plurality of bore segments that extends within the monolithic fluid end body. A bore segment of the plurality of bore segments interfaces with a reciprocating element that creates suction and discharge pressures in the suction chamber, and at least two bore segments of the plurality of bore segments support respective valves configured to control ingress and egress of fluid with respect to the suction chamber. The plurality of passages interconnects pairs of the plurality of bore segments so that fluid can flow from one of the respective valves to another of the respective valves in response to reciprocation of the reciprocating element.

In accordance with at least one other embodiment, the present application is directed to a fluid end body. The fluid end body includes a first bore segment having a suction chamber, a second bore segment configured to receive fluid from the first bore segment and direct fluid toward an exterior of the fluid end body, and a plurality of passages configured to direct fluid into the first bore segment and then into the second bore segment. The first bore segment is configured to interface with a reciprocating element that creates suction and discharge pressures in the suction chamber, and passages of the plurality of passages are intertwined with one another In accordance with at least one further embodiment, the present application is directed to a fluid end. The fluid end includes a casing, an inlet formed in an external surface of the casing, a first bore segment formed in the casing to define a suction confluence region, a second bore segment formed in the casing to define a discharge confluence region, a suction passage formed in the casing and extending from the inlet to the suction confluence region, and a discharge passage formed in the casing and extending from the suction confluence region to the discharge confluence region. The suction passage and the discharge passage are intertwined with one another

BRIEF DESCRIPTION OF THE DRAWINGS

The apparatuses, systems, and components presented herein may be better understood with reference to the following drawings and description. It should be understood that some elements in the figures may not necessarily be to scale and that emphasis has been placed upon illustrating the principles disclosed herein. In the figures, like-referenced numerals designate corresponding parts throughout the different views.

DETAILED DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1:
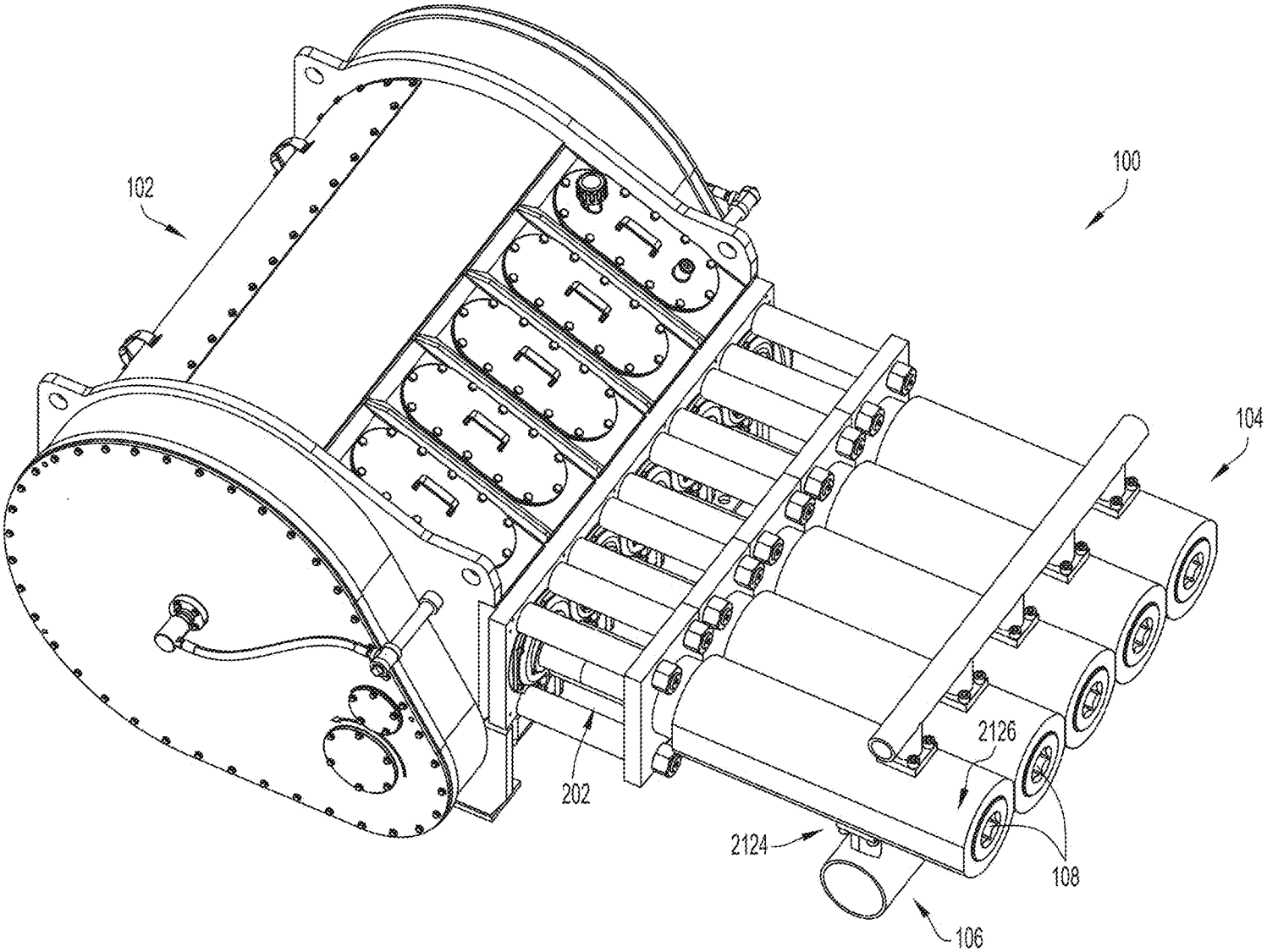
FIG. 1 is a perspective view of a reciprocating pump including a fluid end, in accordance with aspects of the present disclosure.

Referring to FIG. 1, depicted is a reciprocating pump 100 (e.g., a linear reciprocating pump). The reciprocating pump 100 includes a power end 102 and a fluid end 104. The power end 102 includes a crankshaft that drives a plurality of reciprocating plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

The fluid end 104 includes one or more reciprocating elements 202, such as plungers or pistons, which are configured to reciprocate relative to a pumping chamber defined by the fluid end 104. Specifically, with each stroke of the reciprocating element 202, low pressure fluid is drawn into the pumping chamber and high pressure fluid is discharged from the pumping chamber. The pumping paths and pumping chambers of the fluid end 104 generally extend longitudinally along the same axis as the reciprocating element 202. However, in alternative embodiments, the pumping path and pumping chambers of the fluid end 104 may be oriented in another manner, such as perpendicular to one another. The fluid end 104 includes an intake portion 2124 that fluidly connects the pumping chamber of the reciprocating element 202 to a piping system 106 delivering fluid to the fluid end 104. The fluid end 104 also includes a discharge portion 2126 that allows fluid to exit the fluid end 104. In at least some embodiments, reciprocation of the reciprocating element 202 causes fluid to enter the intake portion 2124 via pipes of the piping system 106, through the fluid end body, into the pumping chamber, through the discharge portion 2126, and into a channel 108. However, the piping system 106 and the channel 108 are merely example conduits and, in various embodiments, the fluid end 104 may receive and discharge fluid via any quantity of pipes and/or conduits, along pathways of any desirable size or shape.

Figure 2:
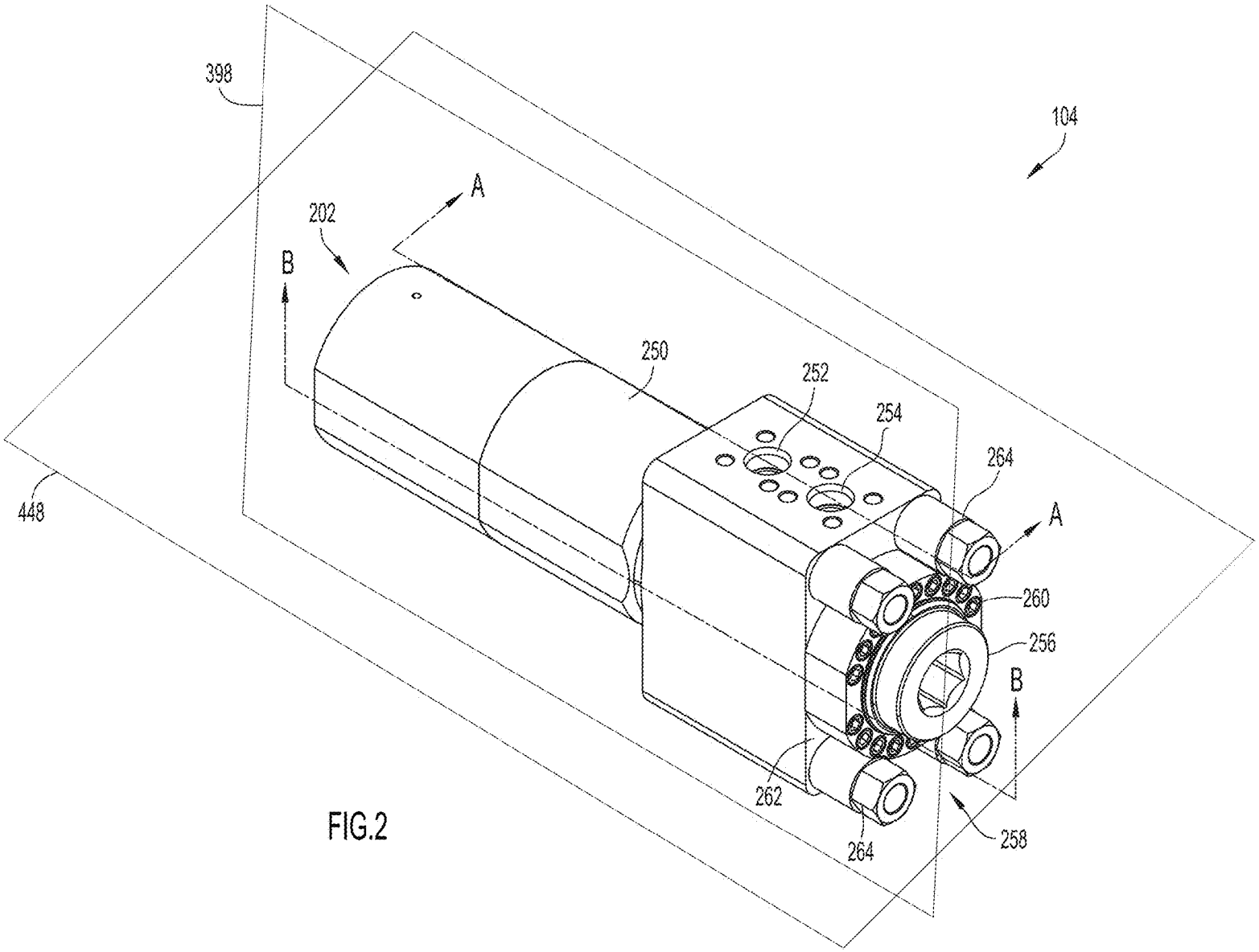
FIG. 2 is a perspective view of a portion of the fluid end of FIG. 1.

FIG. 2 shows a perspective view of a portion of the fluid end 104. The illustrated portion of the fluid end 104 includes the reciprocating element 202. That is, the fluid end 104 includes a fluid end body or a casing 250 configured to interface with the reciprocating element 202. Although FIG. 2 depicts a fluid end 104 that receives a single reciprocating element 202, it should be noted that a fluid end 104 can include multiple reciprocating elements 202, along with multiple associated pumping chambers, arranged side-by-side. By way of example, the fluid end body 250 may form or interface with a plurality of pumping chambers in which a plurality of reciprocating elements 202 is disposed. However, a plurality of pumping chambers needs not be defined by or interface with a single fluid end body. For example, in some embodiments, the fluid end 104 may be modular, and different fluid end body segments may house or interface with one or more pumping chambers. In any case, the one or more pumping chambers may be arranged side-by-side so that corresponding conduits are positioned adjacent to each other and generate substantially parallel pumping action.

The fluid end body 250 includes an inlet 252 configured to receive fluid, such as from the piping system 106 (FIG. 1). The fluid end body 250 also includes an outlet 254 configured to deliver fluid, such as to the channel 108 (FIG. 1). The fluid end body 250 further defines or includes passages (not shown in FIG. 2) to control fluid flow through the pumping chamber during operation of the fluid end 104. For example, the passages define a counterflow path to enable fluid flow into the fluid end 104 and out of the fluid end 104. The counterflow path is connected to the inlet 252 of the fluid end body 250 and is therefore configured to receive fluid flow entering the fluid end body 250. That is, the counterflow path is configured to direct the fluid flow from the inlet 252 to the pumping chamber. The counterflow path is also connected to the outlet 254 of the fluid end body 250 and is therefore configured to direct fluid end from the pumping chamber to the outlet 254. The counterflow path can be considered to collectively form a fluid routing plug or element within the fluid end body 250 to direct fluid into and out of the pumping chamber of the fluid end body 250.

In some embodiments, the fluid end body 250 includes a hole (not shown) to enable access to components within the fluid end body 250, such as for a maintenance operation (e.g., inspection, repair, replacement). To block undesirable flow of fluid out from within the fluid end body 250 through the hole, a retainer 256 is secured at an end 258 of the fluid end body 250 to cover the hole. For example, a lock ring 260 may be secured to a surface 262 of the fluid end body 250 at the end 258 (e.g., via fasteners), and the retainer 256 may be coupled to the lock ring 260 to cover the hole. Moreover, securement features 264 (e.g., bolts, nuts, sleeves) are coupled to the fluid end body 250 at the end 258 to help couple the fluid end body 250 to a power end (e.g., the power end 102). As an example, couplers (e.g., stay rods) that are secured to the power end may extend through openings (not shown) formed through the fluid end to be exposed at the end 258. The securement features 264 mount to the couplers to secure the couplers to the fluid end body 250, thereby securing the fluid end body 250 to the power end.

In some embodiments, the fluid end body 250 defining the passages may be manufactured using an additive manufacturing process (e.g., three-dimensional printing) in which layers of material are sequentially provided and fused. Thus, the passages may be directly formed into the fluid end body 250. As such, the fluid end body 250 includes a single, integral (e.g., monolithic) piece having the passages formed therein. For this reason, the fluid end body 250 readily provides the counterflow path to direct fluid flow through the fluid end 104 without having to use an additional component, separate from the fluid end 104, to provide fluid flow passages. Indeed, the fluid end body 250 functions to enable both suction and discharge of fluid. Therefore, implementation of separate components dedicated for one of suction or discharge of fluid with respect to the fluid end body 250 may be avoided. As such, a quantity of components that otherwise may be needed to setup and operate the fluid end 104 may be reduced as compared to, for example, fluid ends with separate casings and routing plugs.

More specifically, when setting up and operating the fluid end 104, there will be a limited number of components to be coupled together and/or installed in the fluid end 104. In turn, this will reduce the number of seals required in the fluid end 104, reduce the number of components acting on each other (creating friction, wear, stress, etc.), and reduce the number of components to be kept in an operator's stock/inventory. Additionally or alternatively, the numbers of steps required during manufacturing may be reduced. This is because the manufacturer may eliminate or reduce a number of coupling operations that couple separate components to one another, a number of separately manufactured (and inspected) components, a number of pressure/force determinations and tests required to determine limits to maintain desirable coupling, and so forth. Additionally or alternatively, usage of a single, integral fluid end body 250 having the counterflow path may avoid or reduce the number of relatively weak areas that otherwise may be introduced at the interface between multiple, separate components that are coupled to one another to form the fluid end body. As a result, a structural integrity of the fluid end 104 may be improved to increase a useful lifespan of the fluid end 104.

Figure 3:
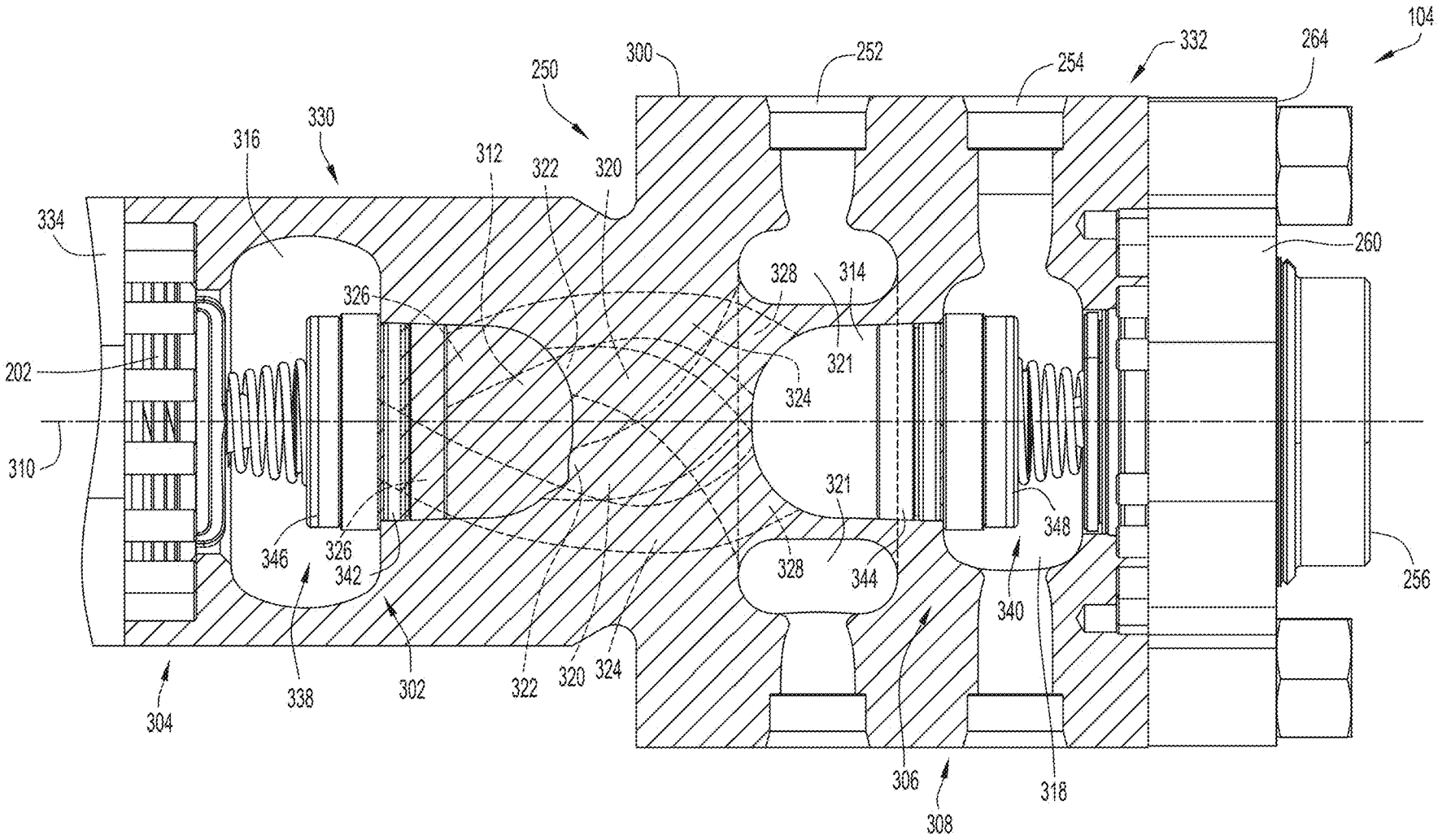
FIG. 3 is a side view of a portion of the fluid end of FIGS. 1 and 2 with transparent features providing semi-sectional views.

Turning to FIG. 3, a side view of a portion of the fluid end 104 is shown. Each of the inlet 252 and the outlet 254 is formed through a sidewall 300 of the fluid end body 250 of the fluid end 104 at an external surface of the fluid end body 250. Additionally, a first bore segment 302 (e.g., a suction bore segment) is formed at a first end 304 (e.g., through a first surface) of the fluid end body 250, and a second bore segment 306 (e.g., a discharge bore segment) is formed at a second end 308 (e.g., through a second surface) of the fluid end body 250. The first bore segment 302 and the second bore segment 306 are linearly aligned with one another in the illustrated embodiment such that an axis 310 extends through respective centers of the bore segments, but it should be noted that the first bore segment 302 and the second bore segment 306 may be oriented in any other suitable manner in alternative embodiments. The first bore segment 302 forms or defines a suction confluence region 312 (e.g., a suction confluence bowl, a suction junction) within the fluid end body 250, and the second bore segment 306 forms or defines a discharge confluence region 314 (e.g., a discharge confluence bowl, a discharge junction) within the fluid end body 250. Moreover, a suction chamber 316 fluidly coupled to the suction confluence region 312 is formed within the fluid end body 250 at the first bore segment 302, and a discharge chamber 318 fluidly coupled to the discharge confluence region 314 is formed within the fluid end body 250 at the second bore segment 306. A plurality of passages is further formed in the fluid end body 250 to interconnect the bore segments 302, 306 to one another.

For example, suction passages 320 are formed in the fluid end body 250 to fluidly couple the inlet 252 to the suction confluence region 312 defined by the first bore segment 302. Thus, fluid is configured to enter fluid end body 250 at the inlet 252, then flow into the suction passages 320 from the inlet 252 via suction intake openings 321, flow into the suction confluence region 312 from the suction passages 320 via suction output openings 322, and flow into the suction chamber 316 from the suction confluence region 312. Discharge passages 324 are formed in the fluid end body 250 to fluidly couple the suction chamber 316 to the discharge confluence region 314. As such, fluid is configured to flow into the discharge passages 324 from the suction chamber 316 via discharge intake openings 326, into the discharge confluence region 314 from the discharge passages 324 via discharge output openings 328, and into the discharge chamber 318 from the discharge confluence region 314. The outlet 254 extends to the discharge chamber 318 to enable fluid to flow from the discharge chamber 318 via the outlet 254 and exit the fluid end body 250. The suction passages 320 and discharge passages 324, along with the suction intake openings 321, the suction output openings 322, the suction confluence region 312, the suction chamber 316, the discharge intake openings 326, the discharge output openings 328, the discharge confluence region 314, and/or the discharge chamber 318, can be considered a fluid routing plug or feature that directs fluid flow into and out of a pumping chamber of the fluid end 104.

Each of the suction passages 320 and the discharge passages 324 crosses the axis 310 extending through the respective centers of the bore segments 302, 306. As an example, the suction passages 320 and discharge passages 324 extend in a helical direction or along another suitable route to intertwine with one another, thereby reducing a physical footprint occupied by the suction passages 320 and by the discharge passages 324. Accordingly, the suction passages 320 and the discharge passages 324 are positioned closer to one another to achieve efficient usage of space within the fluid end body 250. For instance, a limited dimension (e.g., width, thickness) of the fluid end body 250 may be able to accommodate the depicted arrangement of the suction passages 320 and the discharge passages 324. Additionally or alternatively, a fluid end body 250 of a certain size may be able to increase a previously limited dimension (e.g., radius, width) of passages 320 and 324. In any case, less material may be used to manufacture the fluid end body 250 to provide the suction passages 320 and the discharge passages 324, thereby reducing a cost associated with manufacturing the fluid end body 250.

The fluid end body 250 includes a first portion 330 and a second portion 332 in which the second portion 332 extends radially beyond the first portion 330. For example, each of the inlet 252, the outlet 254, the discharge confluence region 314, and the discharge chamber 318 may be formed in the second portion 332, and the second portion 332 may be sized to accommodate positioning of the inlet 252, of the outlet 254, of the discharge confluence region 314, and of the discharge chamber 318 relative to one another. Meanwhile, the suction confluence region 312 and the suction chamber 316 may be formed in the first portion 330, and the first portion 330 may be sized to accommodate positioning of the suction confluence region 312 and of the suction chamber 316 relative to one another. The first portion 330 is configured to engage with the reciprocating element 202, such as with a cylinder 334 in which the reciprocating element 202 is disposed and configured to move therethrough. By way of example, the first portion 330 causes the first bore segment 302 to interface with the reciprocating element 202 such that movement of the reciprocating element 202 drives fluid flow through the fluid end body 250. The second portion 332 is configured to interface with the lock ring 260 and the retainer 256 to block undesirable fluid flow out of the second bore segment 306 (e.g., through the second end 308).

In the illustrated embodiment, the inlet 252 is positioned to overlap with the discharge confluence region 314 along a length of the axis 310 extending through the respective centers of the bore segments 302, 306. Thus, the inlet 252 is positioned adjacent to the outlet 254 that receives fluid from the discharge confluence region 314, and the suction intake openings 321 that receive fluid from the inlet 252 are positioned adjacent to the discharge confluence region 314. The positioning of the inlet 252 and the outlet 254 adjacent to one another may further increase efficient usage of space of the fluid end body 250 (e.g., by limiting a length of the fluid end body 250 for accommodating arrangement of the inlet 252 and the outlet 254), such as compared to an embodiment in which an inlet and an outlet are positioned farther away from one another. For instance, the illustrated positioning of the inlet 252 and the outlet 254 may enable routing of the intertwining suction passages 320 and discharge passages 324. However, in alternative embodiments, the inlet 252 may be positioned at any other suitable location, such as at the second portion 332 of the fluid end body 250. Moreover, the first portion 330 and the second portion 332 may be configured (e.g., offset) in any suitable manner relative to one another.

Additionally, the bore segments 302, 306 support respective valves configured to control fluid flow through the fluid end body 250. As an example, a first valve assembly 338 is configured to be disposed in the first bore segment 302, and a second valve assembly 340 is configured to be disposed in the second bore segment 306. A first valve seat 342 of the first valve assembly 338 is positioned to extend into the suction confluence region 312 such that the fluid end body 250 captures the first valve seat 342 to secure the first valve seat 342 within the first bore segment 302. A second valve seat 344 of the second valve assembly 340 is positioned to extend into the discharge confluence region 314 such that the fluid end body 250 captures the second valve seat 344 to secure the second valve seat 344 within the second bore segment 306. A first valve 346 (e.g., a suction valve) of the first valve assembly 338 is configured to engage with the first valve seat 342, and a second valve 348 (e.g., a discharge valve) of the second valve assembly 340 is configured to engage with the second valve seat 344. The suction passages 320 and the discharge passages 324 enable fluid flow from the first valve 346 to the second valve 348 in response to reciprocation of the reciprocating element 202, and the valves 346, 348 work with the suction passages 320 and/or with the discharge passages 324 to control fluid flow through the fluid end body 250. Although the illustrated valve assemblies 338, 340 include valve seats 342, 344 configured to engage with the valves 346, 348, in additional or alternative embodiments, the valves 346, 348 are configured to directly engage with the fluid end body 250 without usage of valve seats 342, 344. For example, the first valve 346 is configured to engage with the fluid end body 250 at the suction confluence region 312, and the second valve 348 is configured to engage with the fluid end body 250 at the discharge confluence region 314.

Additionally, in some embodiments, the fluid end body 250 may be adjusted relative to a remainder of the fluid end 104 to expose the first bore segment 302 and/or the second bore segment 306, thereby enabling access to the first valve assembly 338 and/or to the second valve assembly 340, such as for maintenance (e.g., inspection, removal, replacement, repair). By way of example, the cylinder 334 may be disengaged from the first portion 330 to expose the first bore segment 302, and/or the retainer 256 and/or the lock ring 260 may be disengaged from the second portion 332 to expose the second bore segment 306. Thus, the valves 346, 348 may become readily accessible.

Figure 4:
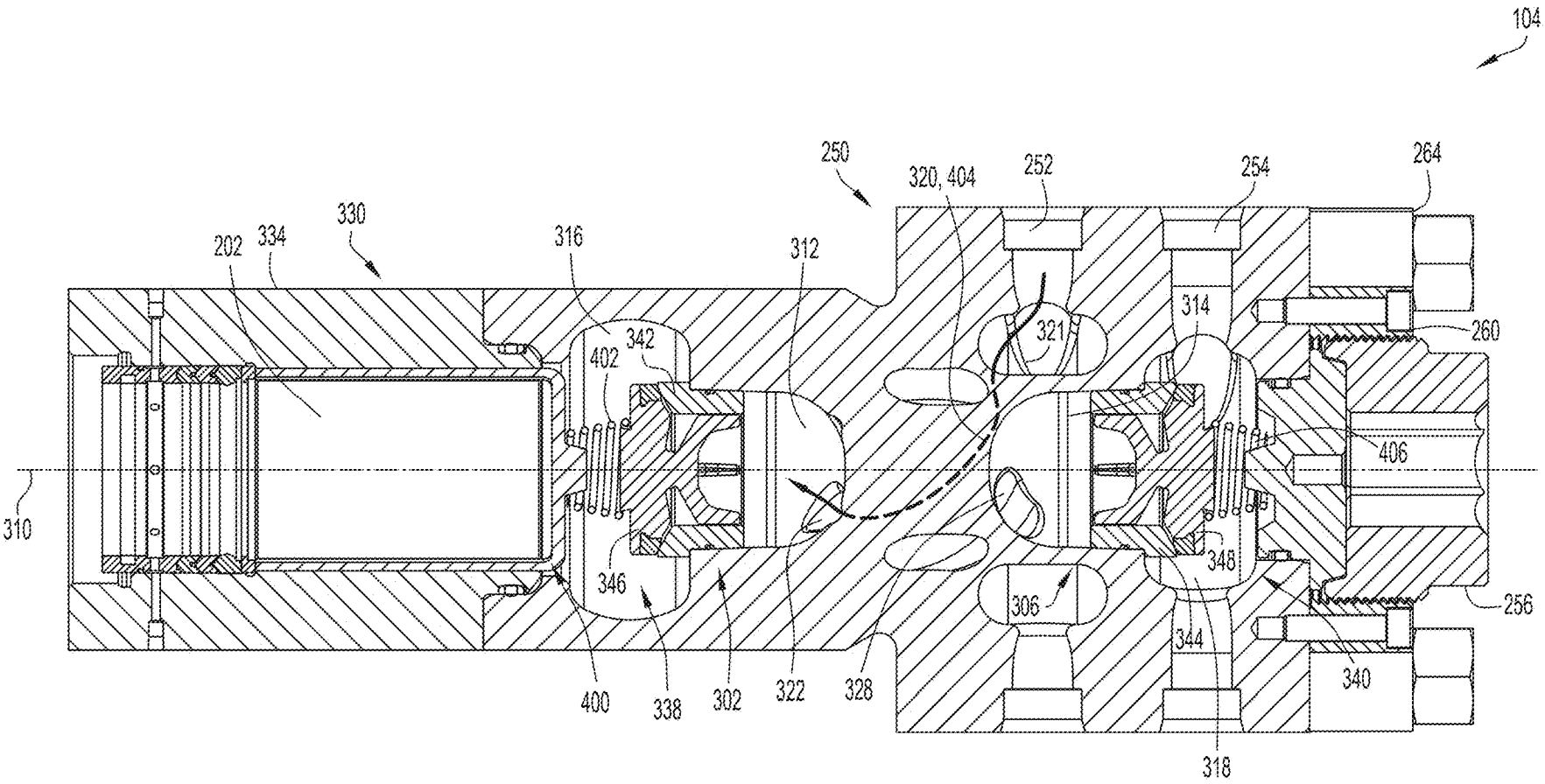
FIG. 4 is a side cross-sectional view of the portion of the fluid end of FIG. 2 taken along a line A-A.

FIG. 4 is a side cross-sectional view of the portion of the fluid end 104 of FIG. 2 taken along a line A-A to provide a first cutting plane 398 (see FIG. 2). In the illustrated embodiment, the first portion 330 of the fluid end body 250 engages with the cylinder 334 such that a pumping chamber 400 is fluidly coupled to the suction chamber 316. As such, the first bore segment 302 interfaces with the reciprocating element 202. Therefore, movement of the reciprocating element 202 within the pumping chamber 400 adjusts a pressure of the suction chamber 316. As an example, movement of the reciprocating element 202 away from the suction chamber 316 increases an overall volume collectively formed by the suction chamber 316 and pumping chamber 400, thereby creating a suction pressure within the suction chamber 316. As another example, movement of the reciprocating element 202 toward the suction chamber 316 reduces the overall volume collectively formed by the suction chamber 316 and pumping chamber 400, thereby creating a discharge pressure within the suction chamber 316. Such movement of the reciprocating element 202 causes fluid flow through the fluid end body 250.

The valves 346, 348 (e.g., one-way valves) respectively allow fluid flow selectively through the fluid end body 250. The first valve 346 is configured to control ingress of fluid into the suction chamber 316. For example, a first biasing element 402 of the first valve assembly 338 couples the first valve 346 to the cylinder 334 and urges the first valve 346 toward the suction confluence region 312 to block undesirable fluid flow between the suction confluence region 312 and the suction chamber 316 (e.g., via a sealed engagement between the first valve 346 and the first valve seat 342). However, movement of the reciprocating element 202 away from the suction chamber 316 reduces a pressure of the suction chamber 316 to draw fluid into the fluid end body 250 via the inlet 252 and to direct fluid through the suction passages 320 (represented by a suction flow path 404) and into the suction confluence region 312. Buildup of fluid within the suction confluence region 312 forces the first valve 346 away from the suction confluence region 312 (e.g., and out of engagement with the first valve seat 342) to enable fluid flow into the suction chamber 316 (e.g., via a space formed between the first valve 346 and the first valve seat 342). Thus, the first valve 346 is configured to block ingress of fluid into the suction chamber 316 until the reciprocating element 202 moves away from the suction chamber 316.

The suction flow path 404 illustrates fluid flow direction through one of the suction passages 320 from the inlet 252 (e.g., via the suction intake opening 321 adjacent to the discharge confluence region 314) to the suction confluence region 312 (e.g., via a suction output opening 322). The suction flow path 404, and therefore the suction passage 320, crosses the axis 310 extending through the respective centers of the bore segments 302, 306 along the first cutting plane provided by the line A-A. Such routing of the suction passage 320 provides a sufficient amount of remaining space within the fluid end body 250 to accommodate routing of the discharge passages 324 and/or another suction passage 320 between the suction confluence region 312 and the discharge confluence region 314.

The fluid is configured to flow into and/or fill the suction chamber 316 and/or the pumping chamber 400 upon intake via the suction flow path 404 and subsequent flow through the suction confluence region 312. The reciprocating element 202 is then configured to move toward the suction chamber 316 to increase a pressure within the suction chamber 316, thereby pressurizing the fluid and directing the pressurized fluid from the suction chamber 316 and/or from the pumping chamber 400, through the discharge passages 324 (not shown in FIG. 4), and into the discharge confluence region 314. The second valve 348 is configured to control egress of fluid from the discharge confluence region 314 into the suction chamber 316. For instance, a second biasing element 406 of the second valve assembly 340 couples the second valve 348 to the lock ring 260 and/or the retainer 256 and urges the second valve 348 toward the discharge confluence region 314 to block undesirable fluid flow between the discharge confluence region 314 and the discharge chamber 318 (e.g., via a sealed engagement between the second valve 348 and the second valve seat 344). However, buildup of pressure within the discharge confluence region 314 forces the second valve 348 away from the discharge confluence region 314 (e.g., and out of engagement with the second valve seat 344) to enable fluid flow into the discharge chamber 318 (e.g., via a space formed between the second valve and the second valve seat). As such, the second valve 346 is configured to block egress of fluid from the suction chamber 316 (e.g., and corresponding ingress of fluid into the discharge chamber 318) until the reciprocating element 202 moves toward the suction chamber 316 and generates a cracking pressure.

The outlet 254 is fluidly coupled to the second bore segment 306 via the discharge chamber 318 such that the discharge chamber 318 fluidly couples the discharge confluence region 314 and the outlet 254 to one another. Therefore, fluid in the discharge chamber 318 is configured to flow through the outlet 254. Accordingly, movement of the reciprocating element 202 toward the suction chamber 316 to drive fluid from the suction chamber 316 and/or from the pumping chamber 400 to the discharge chamber 318 discharges pressurized fluid from the fluid end body 250 via the outlet 254.

Figure 5:
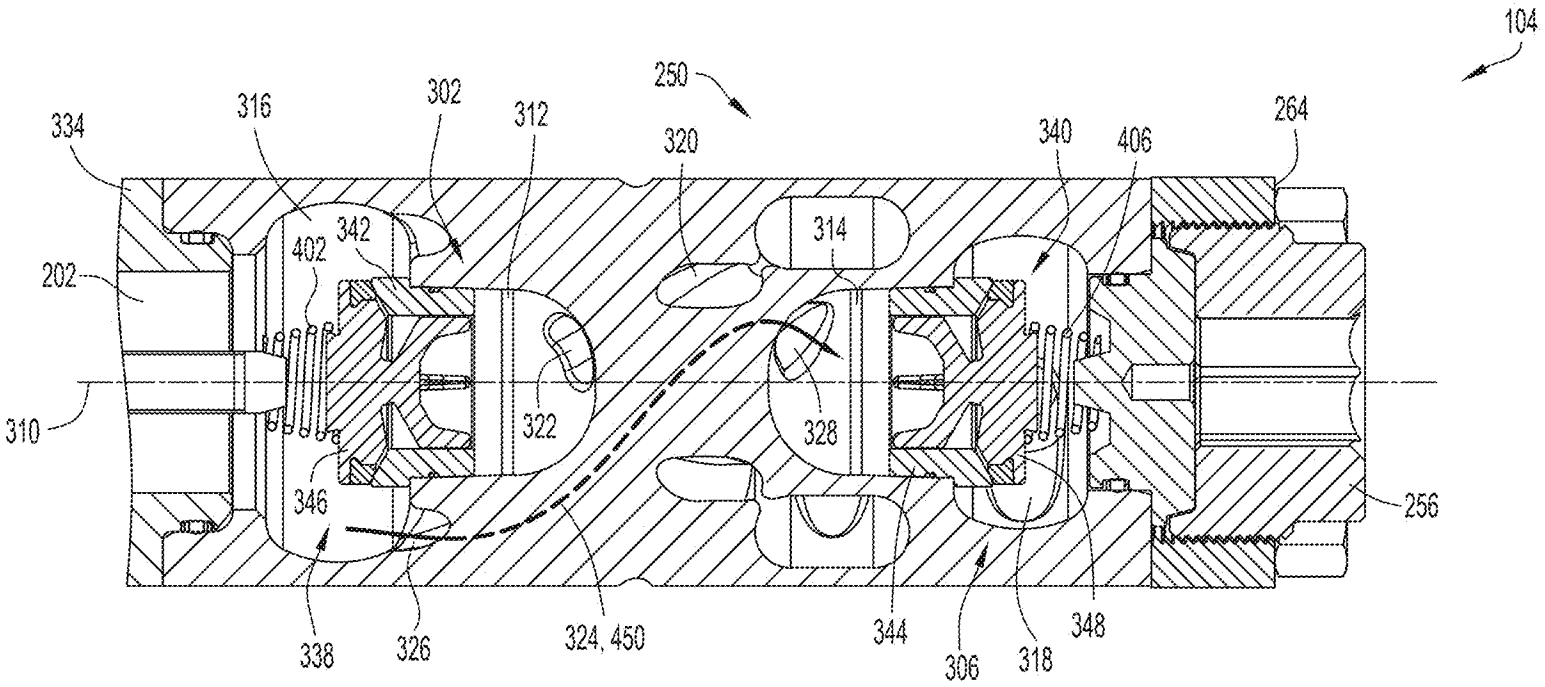
FIG. 5 is a side cross-sectional view of the portion of the fluid end of FIG. 2 taken along a line B-B.

FIG. 5 is a side cross-sectional view of the portion of the fluid end 104 of FIG. 2 taken along a line B-B to provide a second cutting plane 448 (see FIG. 2) that is transverse (e.g., perpendicular) to the first cutting plane 398 provided by the line A-A. In the illustrated embodiment, a discharge flow path 450 of fluid extends through one of the discharge passages 324 from the suction chamber 316 (e.g., via a discharge intake opening 326) to the discharge confluence region 314 (e.g., via a discharge output opening 328). The discharge flow path 450, and therefore the discharge passage 324, crosses the axis 310 extending through the respective centers of the bore segments along the second cutting plane 448 provided by the line B-B. Such routing of the suction passages 320 and the discharge passage 324 intertwines the suction passage 320 and the discharge passage 324 with one another. By way of example, each of the suction passage 320 and the discharge passage 324 may extend in a helical or spiral manner about the axis 310.

Figure 6:
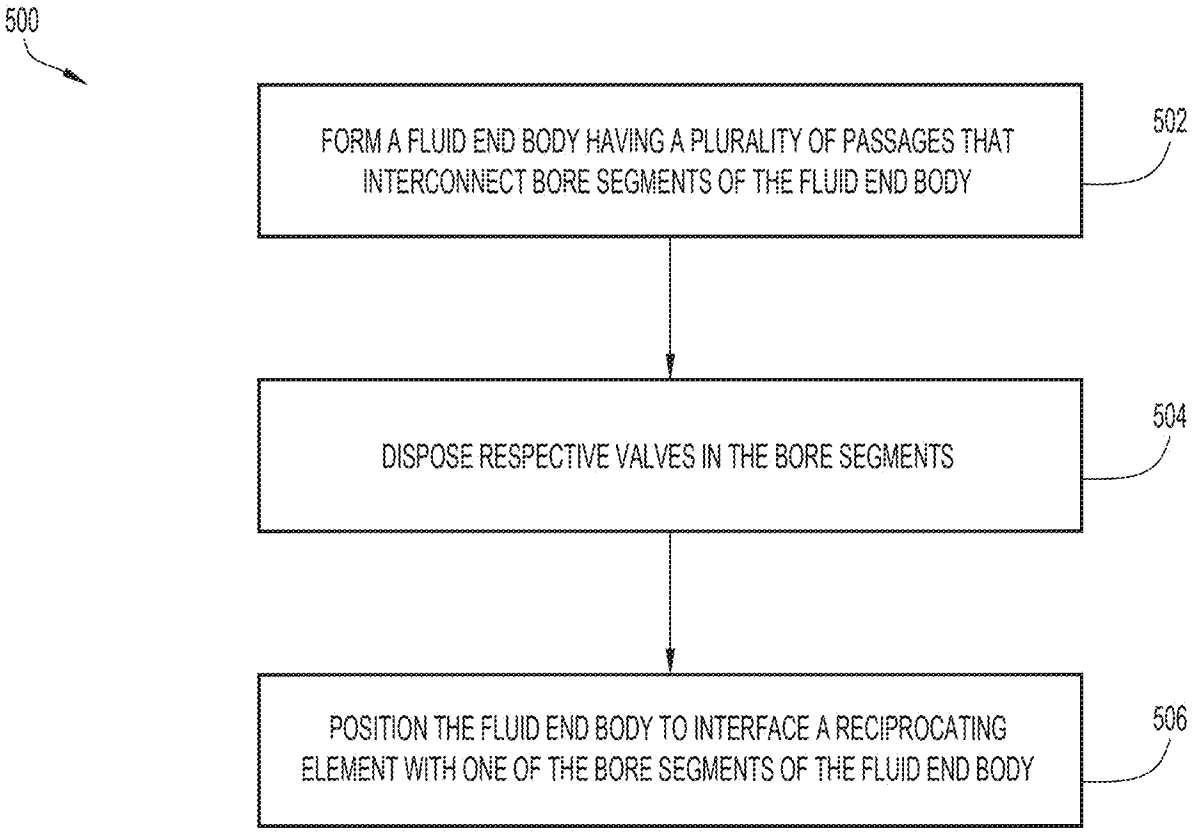
FIG. 6 is a flowchart of a method of manufacturing a fluid end.

FIG. 6 is a flowchart of an embodiment of a method 500 for manufacturing a fluid end, such as the fluid end 104. In some embodiments, the operations of the method 500 may be performed by a single entity. In additional or alternative embodiments, different entities may perform different operations of the method. It should be noted that the method may be performed differently than depicted. For example, a depicted operation may be performed differently, an additional operation may be performed, depicted operations may be performed in a different order, and/or a depicted operation may not be performed.

At block 502, a fluid end body or casing having or defining a plurality of passages that interconnect bore segments (e.g., a pair of bore segments) of the fluid end body is formed. That is, the plurality of passages is integral to the fluid end body. For example, the fluid end body is formed via an additive manufacturing process. As a result, the fluid end body, the plurality of passages, and the bore segments can be formed concurrently with one another using a single manufacturing process, such as without having to separately assemble components (e.g., plugs) dedicated to providing a flow path along which the fluid is directed. The plurality of passages enables fluid to flow from an inlet of the fluid end body to an outlet of the fluid end body.

At block 504, respective valves are disposed in the bore segments of the fluid end body. The respective valves selectively control fluid flow through the fluid end body, and the plurality of passages that interconnect the plurality of bore segments enables fluid to flow from one of the respective vales to another of the respective valves. For example, a first valve controls ingress of fluid into a suction chamber, and a second valve controls egress of fluid from the suction chamber. That is, the valves block undesirable flow of fluid through the fluid end body (e.g., to selectively permit fluid flow with respect to the suction chamber resulting from reciprocation of a reciprocating element). In certain embodiments, respective valve seats are also disposed in the bore segments, and the valves are configured to engage with (e.g., sealingly engage with) the respective valve seats to control ingress and egress of fluid with respect to the suction chamber. In additional or alternative embodiments, the valves are configured to directly engage with the fluid end body to control ingress and egress of fluid with respect to the fluid end body.

At block 506, the fluid end body is positioned to interface a reciprocating element with a bore segment of the fluid end body. By way of example, the reciprocating element is configured to move through a cylinder to adjust a volume of a pumping chamber within the cylinder, and the fluid end body engages with the cylinder such that the fluid end body and the pumping chamber are fluidly coupled to one another. As a result, reciprocation of the reciprocating element adjusts a pressure within the fluid end body (e.g., within the suction chamber) to control fluid flow through the fluid end body. For instance, movement of the reciprocating element to increase the size of the pumping chamber reduces a pressure within the fluid end body and moves the first valve to draw fluid into the fluid end body, and movement of the reciprocating element to reduce the size of the pumping chamber increases a pressure within the fluid end body to pressurize the fluid and moves the second valve to discharge the pressurized fluid from the fluid end body.

While the apparatuses presented herein have been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. For example, any of the components described herein may be modified to be of any shape.

In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the embodiments includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure. Additionally, it is also to be understood that the components discussed herein may be fabricated from any suitable material or combination of materials, such as, but not limited to, plastics, metals (e.g., nickel, copper, bronze, aluminum, steel, etc.), metal alloys, elastomeric materials, etc., as well as derivatives thereof, and combinations thereof, unless otherwise specified. In addition, it is further to be understood that the steps of the methods described herein may be performed in any order or in any suitable manner.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. A fluid end, comprising:

a monolithic fluid end body including a suction chamber and a plurality of bore segments that extends within the monolithic fluid end body, wherein a bore segment of the plurality of bore segments interfaces with a reciprocating element that creates suction and discharge pressures in the suction chamber, and at least two bore segments of the plurality of bore segments support respective valves configured to control ingress and egress of fluid with respect to the suction chamber; and a plurality of passages integrally formed in the monolithic fluid end body to interconnect a pair of the plurality of bore segments so that fluid can flow from one of the respective valves to another of the respective valves in response to reciprocation of the reciprocating element, and wherein passages of the plurality of passages are intertwined with one another.

2. The fluid end of claim 1, wherein the at least two bore segments of the plurality of bore segments include the bore segment and an additional bore segment, and the fluid end comprises:

an intake valve of the respective valves supported by the bore segment, the intake valve controlling ingress of fluid into the suction chamber; and a discharge valve of the respective valves supported by the additional bore segment, the discharge valve controlling egress of fluid from the suction chamber.

3. The fluid end of claim 2, wherein the pair of the plurality of bore segments interconnected by the plurality of passages includes the bore segment and the additional bore segment.

4. The fluid end of claim 2, wherein the monolithic fluid end body further comprises an outlet fluidly coupled to the additional bore segment.

5. The fluid end of claim 4, wherein the monolithic fluid end body further comprises an inlet and a sidewall, and each of the inlet and the outlet is formed through the sidewall.

6. The fluid end of claim 1, wherein the pair of the plurality of bore segments are aligned such that an axis extends through respective centers of the pair of the plurality of bore segments, and each passage of the plurality of passages crosses the axis.

7. The fluid end of claim 6, wherein each passage of the plurality of passages crosses the axis along a different cutting plane.

8. A fluid end body of a fluid end, the fluid end body comprising:

a first bore segment comprising a suction chamber, wherein the first bore segment is configured to interface with a reciprocating element that creates suction and discharge pressures in the suction chamber;

a second bore segment configured to receive fluid from the first bore segment and direct fluid toward an exterior of the fluid end body; and a plurality of passages integrally formed into the fluid end body, wherein the plurality of passages is configured to direct fluid into the first bore segment and then into the second bore segment, and wherein passages of the plurality of passages are intertwined with one another.

9. The fluid end body of claim 8, wherein the first bore segment defines a suction confluence region fluidly coupled to the suction chamber, the second bore segment defines a discharge confluence region, and the plurality of passages comprises:

a suction passage configured to direct fluid from an inlet of the fluid end body to the suction confluence region; and a discharge passage configured to direct fluid from the suction chamber to the discharge confluence region.

10. The fluid end body of claim 9, wherein an axis extends through respective centers of the first bore segment and the second bore segment, and the suction passage and the discharge passage each cross the axis.

11. The fluid end body of claim 10, wherein the suction passage crosses the axis along a first cutting plane, the discharge passage crosses the axis along a second cutting plane, and the first cutting plane and the second cutting plane are transverse to one another.

12. The fluid end body of claim 10, comprising the inlet, wherein the inlet overlaps with the discharge confluence region along a length of the axis.

13. The fluid end body of claim 8, wherein the fluid end body is monolithic.

14. The fluid end body of claim 9, comprising:

the inlet; and an outlet configured to direct fluid from the discharge confluence region out of the fluid end body, wherein the suction confluence region is formed in a first portion of the fluid end body, and the inlet, the outlet, and the discharge confluence region are formed in a second portion of the fluid end body, and the second portion extends radially beyond the first portion.

15. The fluid end body of claim 14, comprising a discharge chamber that fluidly couples the discharge confluence region and the outlet to one another.

16. The fluid end body of claim 15, comprising a valve positioned at the discharge confluence region to selectively block fluid flow from the discharge confluence region into the discharge chamber.

17. A fluid end, comprising:

a casing;

an inlet formed through an external surface of the casing;

a first bore segment formed in the casing to define a suction confluence region;

a second bore segment formed in the casing to define a discharge confluence region;

a suction passage integrally formed in the casing and extending from the inlet to the suction confluence region; and a discharge passage integrally formed in the casing and extending from the suction confluence region to the discharge confluence region, wherein the suction passage and the discharge passage are intertwined with one another.

18. The fluid end of claim 17, wherein the first bore segment and the second bore segment are aligned with one another such that an axis extends through respective centers of the first bore segment and the second bore segment, and the suction passage and the discharge passage extend helically around the axis.

19. The fluid end of claim 17, wherein the first bore segment defines a suction chamber fluidly coupled to the suction confluence region, and the fluid end comprises a reciprocating element configured to create a suction pressure in the suction chamber to direct fluid from the suction passage to the suction chamber via the suction confluence region and to create a discharge pressure in the suction chamber to direct fluid from the suction confluence region to the discharge confluence region via the discharge passage.

20. The fluid end of claim 19, comprising a valve positioned at the suction confluence region to selectively block fluid flow from the suction confluence region to the suction chamber.

* * * * *